US010010478B2

(12) United States Patent
Badita

(10) Patent No.: US 10,010,478 B2
(45) Date of Patent: Jul. 3, 2018

(54) CONSTRUCTION PROFILE FOR SPA TUB BASE

(71) Applicant: Nicolae Badita, Brampton (CA)

(72) Inventor: Nicolae Badita, Brampton (CA)

(73) Assignee: Hydropool Inc., Mississauga, Ontario ( * ) Notice: Subject to any disclaimer, the term of this patent is extended or adjusted under 35 U.S.C. 154(b) by 143 days.

(21) Appl. No.: 14/945,971

(22) Filed: Nov. 19, 2015

(65) Prior Publication Data

US 2016/0143806 A1 May 26, 2016

Related U.S. Application Data

(60) Provisional application No. 62/082,167, filed on Nov. 20, 2014.

(51) Int. Cl.
*A61H 33/00* (2006.01)

(52) U.S. Cl.
CPC ..... *A61H 33/6005* (2013.01)

(58) Field of Classification Search
CPC ..... A61H 33/6005
USPC ..... 4/513, 592–595
See application file for complete search history.

(56) References Cited

U.S. PATENT DOCUMENTS 3,293,815 A * 12/1966 Waldron ..... E04F 19/049 52/288.1
3,561,019 A * 2/1971 Roland ..... A47K 3/16 4/593
4,905,438 A * 3/1990 Brennan ..... A47B 77/06 4/592
7,802,324 B2 * 9/2010 Layfield ..... A61H 33/0087 4/592

* cited by examiner

*Primary Examiner* — Tuan N Nguyen
(74) *Attorney, Agent, or Firm* — Lorelei G. Graham

(57) ABSTRACT

A construction profile for a spa tub base including a top flat surface and an interior top edge extending inward from the top flat surface towards a central plane. An interior engaging surface may extend vertically from the interior top edge down the length of the construction profile. An interior bottom edge extends from the interior engaging surface and outward from the center plane to a bottom stepped surface which may have an attachment groove. An exterior bottom edge may extend outward from the bottom stepped surface and the central plane. An exterior facing surface may extend up from the exterior bottom edge and engage an exterior top edge extending outward from the exterior facing surface to the top flat surface.

10 Claims, 2 Drawing Sheets

CONSTRUCTION PROFILE FOR SPA TUB BASE

FIELD OF THE INVENTION

This invention relates in general to an extruded construction profile and more particularly to a construction profile used as a bottom rail for a spa tub base.

BACKGROUND OF THE INVENTION

The conventional recreational spa tub includes a water-carrying shell, a base, and a series of vertically-oriented support members secured to a base and supporting the shell. The base is often made out of typical construction rails that are very well known and used to construct floor assemblies, such as decks for homes and boat docks. There are, however, several disadvantages with using exposed wood planks for these applications. Wood, if left untreated, can very quickly rot, thus requiring replacement of some if not all of the wood rails. This occurs especially for structures like an outdoor spa tub that are subject to outdoor weather conditions such as rain, snow and sunlight. In addition, wood planks can shrink, creating unsightly and dangerous gaps. Finally, wood is becoming more and more expensive.

Pressure treated lumber is widely used to protect the wood from rotting. However, even pressure treated lumber begins to rot over time with exposure to the elements. In addition, it is recommended by most vendors of pressure treated lumber that a protectant be applied to the wood. This protectant usually must be applied yearly and is therefore time consuming and costly.

Plastic extrusion is a convenient alternative for use in a spa tub base rail as it overcomes the noted problems with wood, however the extrusion process and the plastic extruded spa tub rails themselves still have drawbacks.

Successful extrusion manufacturing requires that every parameter be identified, controlled, and monitored. Some of the variables are based on equipment, others on operating conditions. The variables range from the quality of the die and materials to temperatures and pressures. Some preventative measures can be taken before the manufacturing process even begins. For example, equipment instruments used to monitor temperature, pressure, RPM and amperage should be calibrated twice a year so the readings don't drift over time.

A steady-state process of resin is also essential which begins with how the resin is stored. Typically it needs to be a in a clean, dry area, without being subject to extreme temperature variation. A resin analysis can be conducted to measure the material and record density, melt index, shear rate vs. viscosity data, and tensile strength. Resin that is too dry may not melt and therefore cannot be processed. A change from one batch of resin to another mid-manufacturing process can also result in an altered product. During material lot changes, machine variables have to be monitored more closely in order to make adjustments as needed to maintain efficient extrusion processing and eliminate quality issues with the product.

Typical extrusion problems fall into a few main categories: aesthetic flaws (e.g., pits, black specs, pinholes, drag marks, die lines, sink marks), size variance (which can be intermittent or contiguous); and dimensional variations. The main variables that can occur during the actual process can also be equipment dependent and include: melt pressure, melt temperature, temperature of the barrel, temperature of the die, heater power, cooling power, speed of the screw, the motor load in amps, the speed of the line, die wear or improper design.

When extruding plastic profiles such as a spa tub rail, viability of the end product is usually determined by the cooling of the profile and the ability to hold the part in the correct shape while it is being cooled. It is difficult to cool simple shapes like round pipe and tubing quickly and that difficulty increases when the complexity of the profile increases. Special sophisticated profiles and other complex parts are very difficult to cool uniformly, and if the parts do not cool uniformly warping and bow is the result.

Like most materials, plastics shrink as the temperature of the plastic decreases, but they usually shrink a lot more than other materials. Plastics shrink at one rate when they are in the solid (frozen) state, but they shrink much more when they are still soft or in the molten state. The problem for the profile extruder is controlling this shrinkage when cooling the hot plastic, coming out of the extruder, all the way down to room temperature.

For example, a flat sheet of plastic remains soft as both sides are shrinking at the same rate. Even if one side is cooling faster and shrinking faster the other side is still pliable enough to come along with the other shrinking side. However, once one side cools past the crystalline temperature or its glass transition temperature, two events occur. First, the material stiffens and is no longer pliable enough to follow the other side and the rate of shrinkage goes down significantly. It is as if the stiffened side is no longer shrinking while the other pliable side continues to shrink. Therefore, as the pliable side continues to shrink it is pulling on the stiffened side and causing a bow in the direction of the side that cooled last.

In this example, and in other simple profiles, the part will bow in the direction of the material that cooled last. In more complex profiles the parts may twist, distort, or warp in all types of fashions depending on which sections of the part cooled last.

An additional problem is that plastic is a good thermal insulator and therefore does not transfer heat very fast and does not do it uniformly. Furthermore the thermal conductivity of most plastics is very low at values between 0.1 and 0.30. Attempting to run the plastic profiles faster to increase the length of time the profile has to cool often causes warping, especially with complex hollow shapes having varying wall thicknesses, as well as wood/plastic composites or foamed profiles.

The most effective way to reduce warping is to cool the profile more evenly during the extrusion process by increasing the cooling down time and improve the profile design to make it more symmetric and thinner.

Thus a construction profile for a spa tub base which has improved impact resistance, toughness, UV Resistant, improved surface quality such as gloss is desirable.

SUMMARY OF THE INVENTION

An object of one aspect of the present invention is to provide an improved construction profile for a spa tub base.

In accordance with one aspect of the present invention there is provided a construction profile for a spa tub base including a top flat surface and an interior top edge extending inward from the top flat surface towards a central plane. An interior engaging surface may extend vertically from the interior top edge down the length of the construction profile. An interior bottom edge extends from the interior engaging surface and outward from the centre plane to a bottom stepped surface which may have an attachment groove. An exterior bottom edge may extend outward from the bottom stepped surface and the central plane. An exterior facing surface may extend up from the exterior bottom edge and engage an exterior top edge extending outward from the exterior facing surface to the top flat surface.

Conveniently, the construction profile for a spa tub base is made from extruded plastic allowing for increased cooling down time after extrusion and having a profile that is more symmetric and thinner.

Preferably, the construction profile for a spa tub base has a series of grooves that reduce the amount of material in the profile and aids in attachment to a spa shell and remaining support structure.

Advantages of the present invention are reduced weight of the overall structure, reduction on total material required, environmentally friendly material suitable for recycling, resistant to impact and tough, ultraviolet resistant, colourable, reducing bowing and warping and an improved life span of the spa tub base.

BRIEF DESCRIPTION OF THE DRAWINGS

A detailed description of the preferred embodiments is provided herein below by way of example only and with reference to the following drawings, in which.

Figure 1:
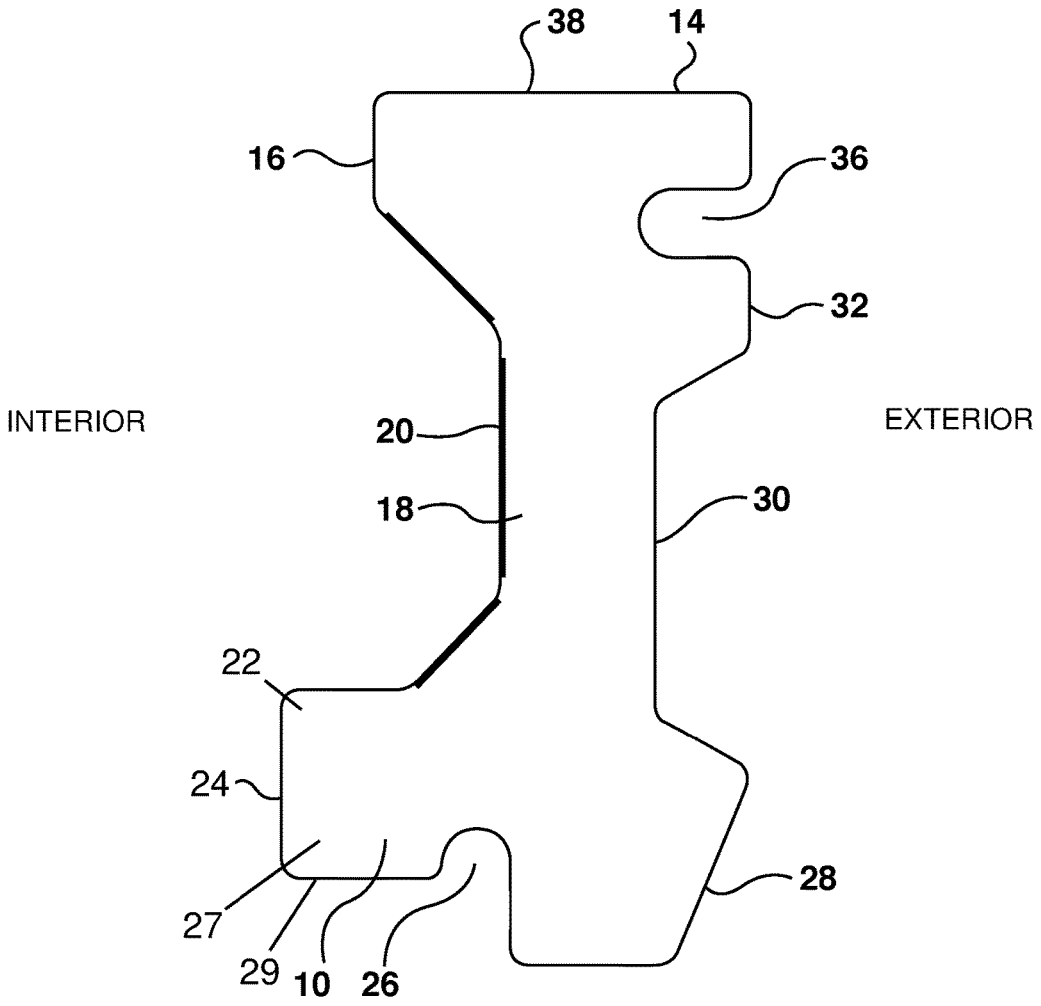
FIG. 1 is a schematic view, illustrates a construction profile for a spa tub base in accordance with a preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 2:
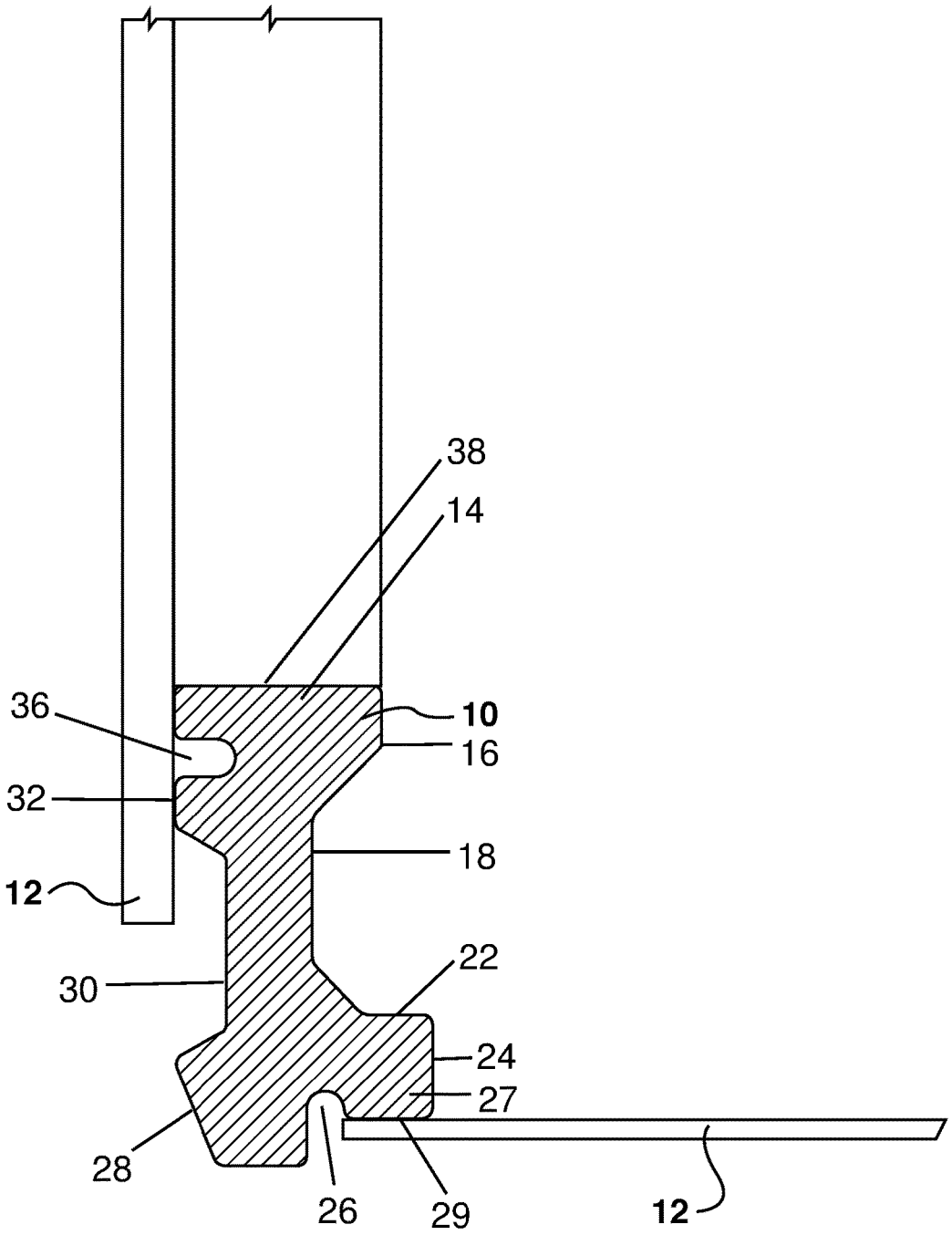
FIG. 2 is a partial cross-sectional view, illustrates a construction profile for a spa tub base in accordance with a preferred embodiment of the present invention.

Referring to FIGS. 1 to 2, there is illustrated in schematic views, a construction profile 10 for a spa tub base 12 in accordance with a preferred embodiment of the present invention. The construction profile 10 for a spa tub base 12 includes a top flat surface 14 and an interior top edge 16 that may extending inward from the top flat surface 14 at an angle ranging from 30-50° towards a central plane 18.

An interior engaging surface 20 may extend vertically down from the interior top edge 16 down a length of the construction profile 10. The interior engaging surface 20 may further be textured to improve adhesion of the adhesive structures and spa tub base 12. An interior bottom edge 22 extends from the interior engaging surface 20 and outward from the centre plane 18 to a bottom stepped surface 24 which may include an attachment groove 26. The bottom stepped surface 24 may be further defined as having an engagement protrusion 27 that engages the spa tub base 12. The engagement protrusion extends inward to form the attachment groove 36 that extends to form a flat bottom surface 29.

An exterior bottom edge 28 may extend outward from the bottom stepped surface 24 and the central plane 18. The exterior bottom edge 28 may extend out at an angle from the flat bottom surface in the range of 110-115°. An exterior facing surface 30 may extend up from the exterior bottom edge 28, up the length of the construction profile 10 to engage an exterior top edge 32. The exterior top edge 32 may extend outward from the exterior facing surface 30 to the top flat surface 14 at an angle having a range of 115-125°.

The top flat surface 14 provides a surface 38 having a sufficient width and length to allow for the attachment of additional support members for the spa shell such as a two by four. The construction profile 10 may extend to any desired length so as to be customized to various spa sizes.

The interior engaging surface 20 may extend vertically at a 90° or may be angled up to 70° to allow for increased access to the attachment groove 26 by finishing tools such as stapling guns or trimming tools by way of example.

The attachment groove 26 may be further defined as an inward extending groove that allows for the spa shell or pan to be easily attached via staples or some other form of attachment mechanism. More specifically the attachment groove 26 may engage additional support members or other adhesive structures. A second groove 36 may be positioned on the exterior top edge 32. The positioning of the second groove 36 provides a reduction in bowing and camber of the construction profile 10. The second groove 36 may have a minimum depth of a quarter of the length of the top flat surface 14.

The construction profile 10 allows for improved mechanical properties, namely durability, strength and ultraviolet resistance. Fibres typically glass fibres and additives can be mixed in the resin pellets to make the construction profile strong and raise the extrusion operating range to as high as 80° C. (176° F.). Pigments may also be added for colour as the raw material original color is translucent ivory to white. Reducing the aging characteristics of the polymers which are largely influenced by the poly-butadiene content is achieved by including antioxidants in the composition. Additional additives help to protect against ultraviolet radiation.

More specifically the construction profile 10 may be extruded from polystyrene foam namely recycled expanded polystyrene so as to be lightweight while maintaining sufficient strength and being environmentally friendly. The construction profile 10 may include a composite of styrene homo-polymer, talc, impact modifier, expanded polystyrene and ultra violet stabilizers. Typically the construction profile 10 includes a minimum of 70% recycled expanded polystyrene with the remaining 30% comprising a blend of the remaining ingredients.

Other variations and modifications of the invention are possible. All such modifications or variations are believed to be within the sphere and scope of the invention as defined by the claims appended hereto.

I claim:

1. A construction profile extrusion for a spa tub base comprising:

(a) a top fiat surface;

(b) an interior top edge extending vertically down and angled gradually inward from the top flat surface towards a central plane;

(c) an interior engaging surface extending vertically from the interior top edge;

(d) an interior bottom edge extending at a gradual angle outward from the interior engaging surface and from the centre plane to a bottom stepped surface that extends downward and has an attachment groove; wherein the attachment groove is a point of attachment for the spa tub base;

(e) an exterior bottom edge extending laterally outward from the central plane and below from the bottom stepped surface and the central plane;

(f) an exterior facing surface vertically extending from the exterior bottom edge, and (g) an exterior top edge extending outward from the exterior facing surface to the top flat surface.

2. The construction profile for a spa tub base as claimed in claim 1 wherein the interior engaging surface extends vertically at a 90°.

3. The construction profile for a spa tub base as claimed in claim 1 wherein interior engaging surface extends at an angle up to 70°.

4. The construction profile for a spa tub base as claimed claim 2 wherein the attachment groove is an inward extending groove allowing an attachment zone for the spa tub base.

5. The construction profile for a spa tub base as claimed in claim 4 wherein the exterior top edge further comprises a second groove.

6. The construction profile for a spa tub base as claimed in claim 5 wherein the second groove has sufficient depth towards the central plane so as reduce bowing and camber of the construction profile.

7. The construction profile for a spa tub base as claimed in claim 6 wherein the depth of the second groove is a minimum of a quarter of the length of the top flat surface.

8. The construction profile for a spa tub base as claimed in claim 7 wherein the bottom stepped surface further comprises an engagement protrusion that engages the spa tub base.

9. The construction profile for a spa tub base as claimed in claim 8 wherein the engagement protrusion extends inward to form the attachment groove that extends to form a flat bottom surface.

10. The construction profile for a spa tub base as claimed in claim 9 wherein the construction profile is extruded from recycled expanded polystyrene.

* * * * *